United States Patent [19]

Last

[11] Patent Number: 5,067,184

[45] Date of Patent: Nov. 26, 1991

[54] COVER DRUM HAVING TAPERED ENDS AND AUTOMATIC SWIMMING POOL COVER

[76] Inventor: Harry J. Last, 1246 Birchwood Dr., Sunnyvale, Calif. 94089

[21] Appl. No.: 494,564

[22] Filed: Mar. 16, 1990

Related U.S. Application Data

[63] Continuation-in-part of Ser. No. 258,000, Oct. 17, 1988, Pat. No. 4,939,798.

[51] Int. Cl.[5] ..... E04H 4/10

[52] U.S. Cl. ..... 4/502; 242/67.1 R; 242/57.1

[58] Field of Search ..... 4/502; 242/57.1, 67.1 R, 242/68.5, 86.52

[56] References Cited

U.S. PATENT DOCUMENTS

| | | | |
|---|---|---|---|
| 2,534,686 | 12/1950 | Stauss et al. | 242/57.1 |
| 3,019,450 | 2/1962 | Karasiewicz | 4/502 |
| 3,050,743 | 8/1962 | Lamb | 4/502 |
| 3,747,132 | 7/1973 | Foster | 4/502 |
| 3,982,286 | 9/1976 | Foster | 4/502 |
| 4,001,900 | 1/1977 | Lamb | 4/502 |
| 4,060,860 | 12/1977 | Lamb | 4/502 |
| 4,494,256 | 1/1985 | Radtke et al. | 4/502 |
| 4,686,717 | 8/1987 | MacDonald et al. | 4/502 |
| 4,939,798 | 7/1990 | Last | 4/502 |

FOREIGN PATENT DOCUMENTS 2072006 9/1980 United Kingdom .

OTHER PUBLICATIONS

1985 Homeowner Manual for the AquaMatic Pool Cover System authored by the Applicant, Harry J. Last, for his company AMCS, Inc.

"History off the Automatic Pool Cover" prepared by the applicant, Harry J. Last and used for promotion of the automatic pool cover system manufactured by AMCS, Inc. and marketed under the trademark Aqua-Matic beginning Jul. 1988.

*Primary Examiner*—Charles E. Phillips

*Attorney, Agent, or Firm*—David E. Newhouse

[57] ABSTRACT

A cover drum having conically tapered hubs at each end provides a mechanism for adjusting alignment of the pool covers of swimming pool cover systems in which the covers have beaded side edges captured and sliding within "C" channels provided by a pair tracks secured along the sides of the swimming pool. Specifically, by translating the cover drum, or alternatively, the conical hubs longitudinally along the rotational axis of the cover drum, one can control the relative rates at which each side of the cover winds and unwinds from around the cover drum as a function of the length of cover extended.

Each conically tapered hub may further include one or more diametrically oriented holes located proximate the apex for receiving a crank enabling the cover drum to be rotated manually.

37 Claims, 4 Drawing Sheets

COVER DRUM HAVING TAPERED ENDS AND AUTOMATIC SWIMMING POOL COVER

RELATED APPLICATIONS

This application is a continuation-in-part of application Ser. No. 07/258,000 filed 10/17/88 now U.S. Pat. No. 4,939,798 by the applicant, Harry J. Last, entitled: "LEADING EDGE AND TRACK SLIDER SYSTEM FOR AN AUTOMATIC SWIMMING POLL COVER", now U.S. Pat. No. 4,939,798.

BACKGROUND OF THE INVENTION

1. Field of the Invention

The invention relates to automatic swimming pool cover systems, and in particular to the cover drum around which a pool cover with beaded side edges winds and unwinds as it retracts and extends across a swimming pool.

2. Description of the Prior Art

Automatic swimming pool cover systems typically include a flexible vinyl fabric sized so that most of it floats on the surface of the pool water. The pool water acts as a low friction surface significantly reducing the amount of force required to move the cover across the pool. The front edge of the cover is secured to a rigid boom spanning the width of the pool for holding the front edge of the cover above the water as it is drawn back and forth across the pool.

To draw the cover across the pool, a cable, typically a Dacron line, is incorporated into and forms a beaded tape which is sewn or attached to the side edges of the pool cover. The beaded tape in turn is captured and slides within a "C" channel of an extruded aluminum track. The track is secured either to the pool deck or the the underside of an overhanging coping along the sides of the swimming pool. The cables extending from the beaded tape sections of the cover are trained around pulleys at the distal ends of the tracks and return in a parallel "C" channel to a drive mechanism where they wind onto cable take-up reels.

To uncover the pool, the drive mechanism rotatably drives a cover drum mounted at one end of the pool winding the pool cover around its periphery unwinding the cables from the take-up reels. To cover the pool the drive mechanism rotatably drives the cable take-up reels winding up the cables to pull the cover across the pool unwinding the cover from the cover drum.

Typically, the cover drum has a length shorter than the width of the pool cover so that the thicker beaded edges of the cover overhang the ends of the drum. This is because the beaded edges of the cover are somewhat thicker than the main body of the cover, and if they were wound around the periphery of the cover drum, the cover winding around the drum would increase in circumference more rapidly at its edges than at its center and therefore, would tend to wind more rapidly than the central body of the cover.

Also to assure that the central section of the cover winds tightly about the periphery of the cover drum, the cover drum may be canted slightly with respect to the cover such that the cover helically winds about the cover drum in a fashion that prevents overlapping of the beaded cover edges. [See U.S. Pat. No. 4,060,860, Lamb, FIGS. 6 and 7.] However, canting of the cover drum for helically winding the cover about its periphery means that the beaded edges of the cover must be allowed to translate relative to the track channels securing the edges of the cover along the sides of the pool, i.e., the cover edges are not aligned with and must be guided into the track channels as the cover winds and unwinds from around the cover drum. [See U.S. Pat. No. 3,050,743, Lamb.]

Also, the rate at which the pool cover unwinds from and winds onto the cover drum depends on the diameter of the roll of the cover still wound around the drum, i.e., the rate is greatest when most of the cover is wound around the drum (largest diameter) and least when the cover is practically unwound from the drum (least diameter). The same phenomenon occurs as the cables wind onto and unwind from the cable reels. It should be appreciated that the cables wind onto the cable reels at the highest rate when the cover unwinds from the cover drum at its lowest rate and visa-versa.

In systems where the cable take-up reels and the cover drum rotate together on the same shaft, but oppositely wind/unwind the cables and cover respectively, a spring is utilized as a tensioning take-up mechanism to compensate for the different and varying rates at which the cables and pool cover wind and unwind from the respective reels and drum during the opening and closing cycles. The spring mechanism lengthens and shortens the cable path as the cover is drawn back and forth across the pool taking up and yielding slack in the respective cables as necessary to compensate for the difference in the winding and unwinding rates of the reels and drum. [See U.S. Pat. Nos. 3,747,132 and 3,982,286, Foster.]

In spring tensioning take-up systems of the type described by Foster, and later floating spring tensioning take-up systems of the type pioneered by Last, the applicant herein, the tensioning of the cables by the spring(s) assures that the cover, and especially its beaded edges curling around the ends of the drum, wind tightly and uniformly without substantial bias around the cover drum as the cover is retracted from across the pool. [See U.S. Pat. No. 3,982,286, Foster, Col. 5, 1.36–Col. 6, 1.4. See also co-pending application Ser. No. 07/258,000, now U.S. Pat. No. 4,939,798.]

In other systems a clutching mechanism is typically utilized to decouple the rotation of the cable reels from that of the cover drum as it is rotatably driven to wind the cover onto the drum uncovering the pool, and to decouple the rotation of the cover drum from that of the cable reels as they are rotatably driven to draw the cover across the pool. Typically, in such systems, the cable reels are allowed to free wheel when the cover drum is rotatably driven and conversely, the cover drum to free wheel when the cable reels are rotatably driven. [See U.S. Pat. Nos. 3,019,450 and 3,050,743, Lamb.]

In such clutch decoupled systems of the type pioneered by Lamb, in order to prevent biasing of the cover as it winds around the cover drum during retraction and to assure that the cover winds compactly and uniformly around the drum, adjustable braking mechanisms are utilized to slow or resist rotation of the respective free wheeling take-up reels to provide the necessary tension in the cables for assuring that cover edges curl around the ends of the cover drum. Such braking mechanisms typically are adjustable for each take-up reel.

In early automatic pool cover systems the rigid boom spanning the width of the pool holding the front edge of the cover above the water was typically supported by a pair of wheeled dollies rolling on the side edges of the pool. The cables moving within the "C" channels of the track along either side of the pool were either directly secured in some fashion to the rigid boom, [Foster, supra], or were indirectly secured to the ends of the boom via fabric interfaces referred to as gores. [See U.S. Pat. No. 4,001,900, Lamb].

Slider mechanisms have now supplanted the use of wheeled dollies for supporting the rigid boom carrying the front edge of the cover. Typically, such slider mechanisms are coupled to the respective ends of the boom and have an edge adapted for capture and sliding within the same or different "C" channels of the extruded track in which the beaded side edge of the cover is captured and slides. [See U.S. Pat. No. 4,686,717, MacDonald et al and U.K. Pat. No. 2,072,006, Lee.]

As pointed out and extensively discussed in co-pending application Ser No. 07/258,000 filed by the Applicant, now U.S. Pat. No. 4,939,798, in systems where slider mechanisms support the rigid boom, it is very important to maintain the boom oriented squarely between the track channels, otherwise the sliders carrying the boom will jam in the track channels stopping extension or retraction of the cover. Even with wheel supported booms, any canting during extension or retraction will tend to pull the beaded cover edge free of the confining track channels particularly at its front corners.

SUMMARY OF THE INVENTION

Conically tapered end sections or hubs located at the respective ends of a cover drum of a swimming pool cover system provide a mechanism for squarely aligning the rigid boom carrying the front or leading edge of a conventional swimming pool cover with beaded side edges, and the cover itself, between a pair of "C" channel tracks secured along the sides of the swimming pool slidably capturing the beaded side edges of the pool cover. In particular, by translating the cover drum and conical hubs or, alternatively, just the conical hubs alone, along the rotational axis of the cover drum, the end diameters of the cover roll can be adjusted to determine both the relative rates and lengths at which the respective sides of the cover wind and unwind from around the cover drum per drum rotation.

A particularly unique aspect of the invented improvement for automatic swimming pool cover systems is that the conically tapering hubs at each end of the cover drum provide a mechanism for adjusting the end diameters of the cover roll as a function of length of cover extended.

In other words, with the conically tapering hubs, the relative rates at which the side regions of the cover wind and unwind from around the cover drum as the cover extends and retracts across the pool can be adjusted by translating the cover drum or the conically tapering hubs along the rotational axis of the cover drum.

A primary advantage of the invented improvement is that excessive cover biasing during retraction and extension can be prevented by appropriate adjustment of the longitudinal position of the cover drum and hubs between the tracks of the invented automatic swimming pool cover system.

Another significant advantage is that adjustment of the longitudinal position of the cover drum and hubs between the tracks can also be utilized to assure square orientation of a rigid boom supported and sliding within the track channels carrying the front edge of the cover across the pool.

Accordingly, a primary objective of the invented improvement is to provide an adjustment mechanism for orienting the rigid booms carrying the front/leading edge of the cover in swimming pool cover system, particularly slider supported booms, squarely between the parallel tracks during extension and retraction of the cover across the pool. (See Applicant's Co-pending application Ser. No. 07/258,000, now U.S. Pat. No. 4,939,798 entitled "Leading Edge and Track Slider System for an Automatic Swimming Pool Cover.")

In particular, the invented improvement, i.e., the conically tapering hubs located at the respective ends of cover drums for swimming pool cover systems provide a mechanism for adjusting the diameters of the respective end "curls" of the beaded cover edges at the ends of the cylindrical portion of the drum, thereby effecting control over the relative rates, and lengths at which the side and central regions of the cover wind and unwind from the cover drum per drum rotation as a function of position of the front or leading edge of the cover.

For example, when the rigid boom carrying the front edge of the cover is proximate the cover drum, with the invented improvement, it is possible to assure that the side regions of the cover wind and unwind faster than its central region, a factor which, as the cover retracts (winds), increases cover tension in the side regions of the cover relative to the central region, and which, as the cover extends (unwinds), relieves tension in the side regions relative to the central region. Conversely, when the rigid boom is distant from the cover drum, with the invented improvement, it possible to assure that the central section of the cover winds and unwinds from the cover drum at greater rate than the side edges, a factor which, during cover extension, relieves tension in the central region relative to the side regions of the cover, and which, during cover retraction, increases cover tension in the central region relative to the side regions.

An advantage provided by the above described operational characteristics or features of the invented improvement is that, during cover retraction, the initial increase of cover tension in the central region relative to the side regions, and then, as the cover approaches the fully retracted position, the increase in tension in the side regions relative to the central region of the cover, causes water trapped on the top surface of the pool cover to initially puddle symmetrically toward the side regions of the cover then toward central mesh covered drain openings proximate the rigid boom.

Another advantage provided by the described operational characteristics or features provided by the invented improvement, during cover extension, is that the initially decrease of tension in the side regions of the cover relative to the central region allows the cover to billow down for support on the water surface reducing both load and frictional resistance. Then the increase in tension of the side regions relative to the central region of the cover as it reaches the fully extended position has the effect of causing water thereafter collecting on the surface of the cover to puddle toward the central rather than the side regions of the cover, thus, mitigating, to some degree, a drowning hazard presented by such puddling water to people and small children inadvertently falling or stepping onto the covered surface of the pool.

Another advantage of the invented improvement is that the beaded side edges of the covers of the swimming pool cover systems can be wound around the conically tapering hubs of the cover drums in relative alignment with the "C" channels of the tracks secured along the sides of the pool in which the beaded edges are captured and slide.

Still another aspect of the control mechanisms provided by the invented hubs is that, in combination with diagonally oriented strips of foam material secured to the surface of the pool cover for increasing the diameter of the cover roll in a transverse region of the cover roll, the respective rates of cover wind-up between the central and side regions of the cover can be effectively varied and controlled at different stages of cover wind-up around the drum.

Finally, the invented conically tapering hubs include diametrically oriented holes for accommodating a crank enabling the cover drum to be manually rotated for retracting and extending the cover across the swimming pool.

Still other features, aspects, advantages and objects presented and accomplished by the invented system utilizing a cover drum with conically tapered hubs for winding up a pool cover will become apparent and/or be more fully understood with reference to the following description and detailed drawings of preferred and exemplary embodiments.

DESCRIPTION OF PREFERRED AND EXEMPLARY EMBODIMENTS

Figure 1:
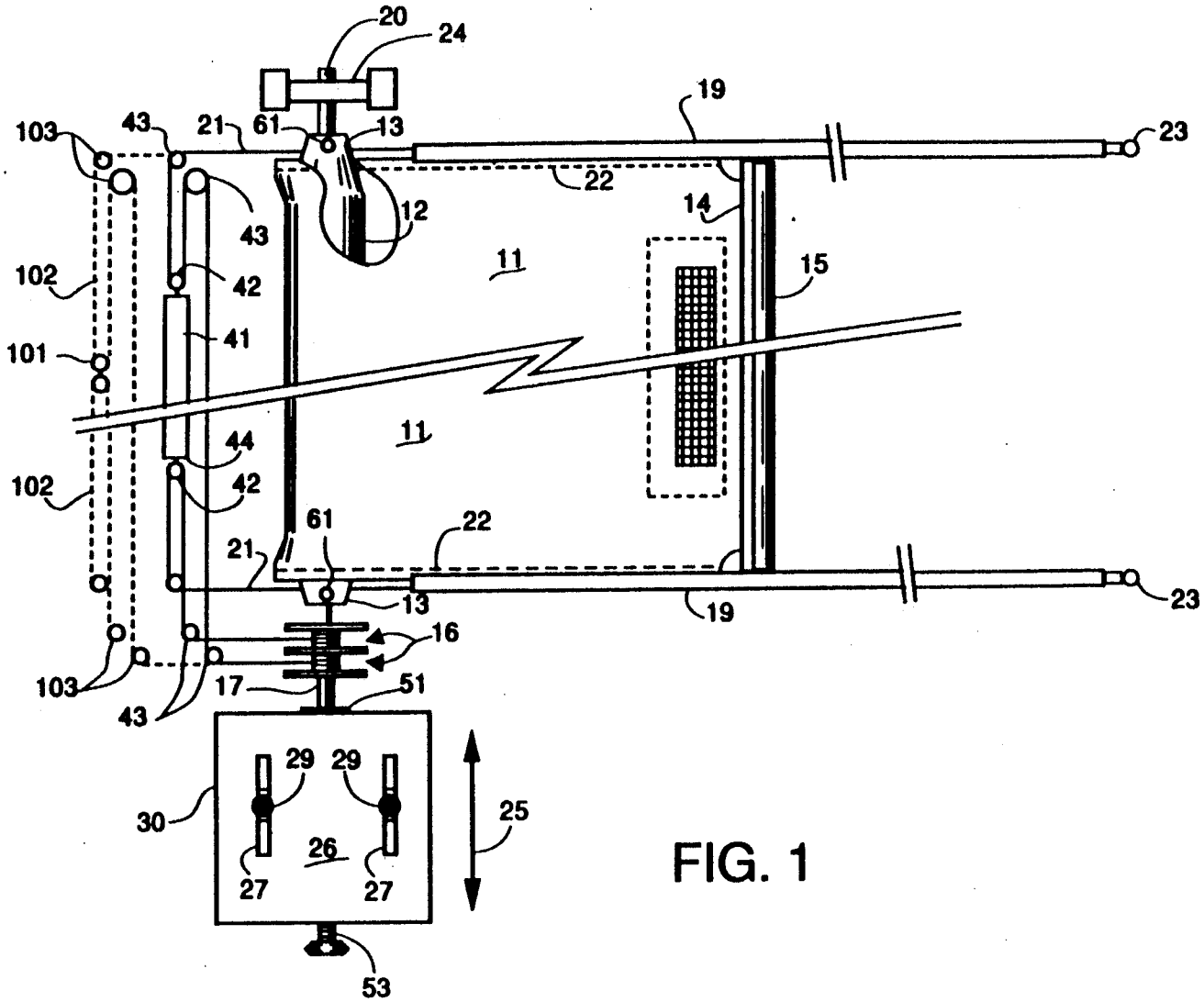
FIG. 1 is a top plan schematic view of an automatic swimming pool cover system incorporating a cover drum with conically tapered ends.
Figure 2:
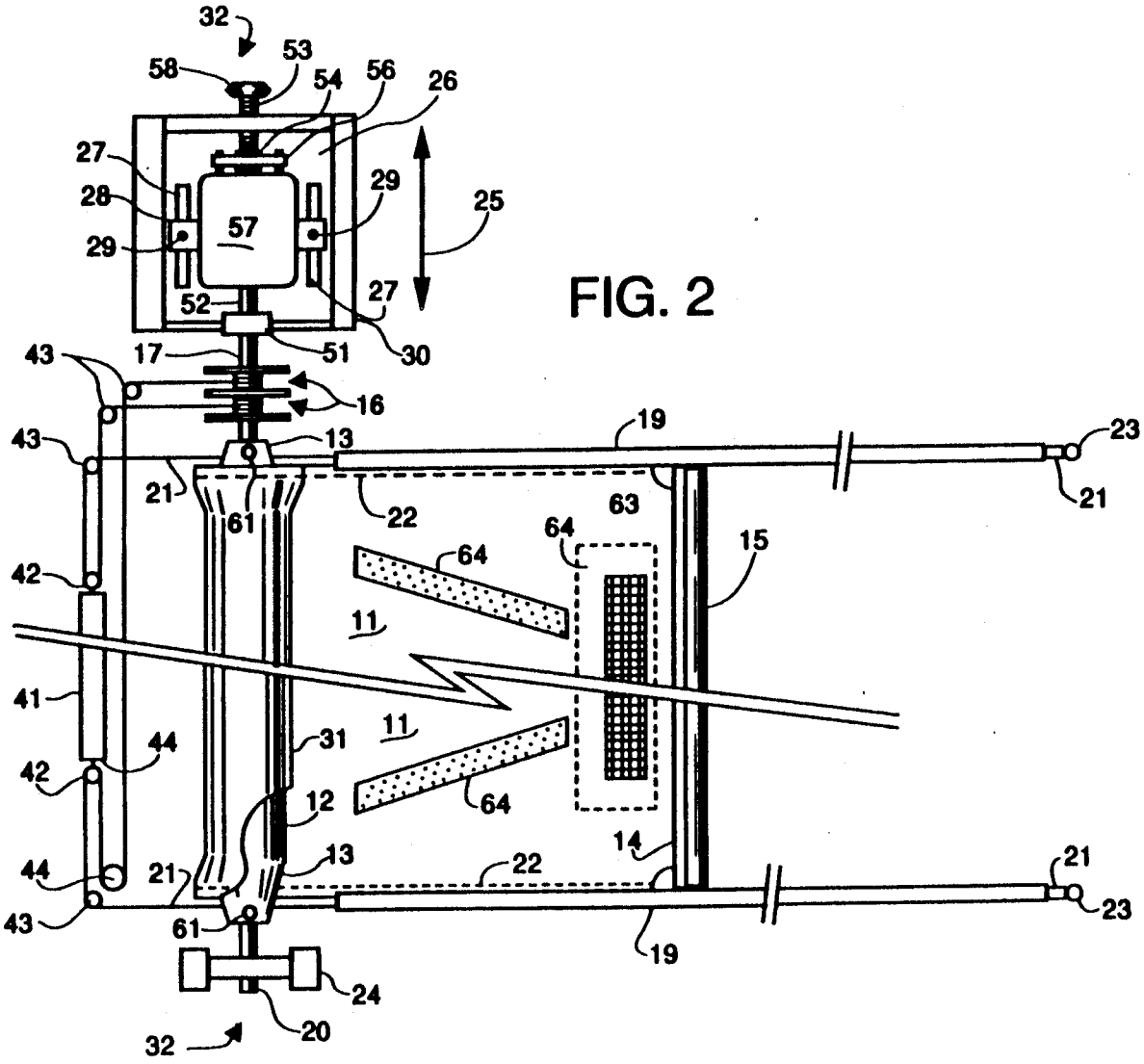
FIG. 2 is a bottom plan schematic view of the automatic swimming pool cover system shown in FIG. 1 illustrating the position of foam strips fastened to the undersurface of the pool cover.

Referring to FIGS. 1 and 2, a top and bottom plan views of an automatic pool cover system are shown which includes a leading edge and slider system of the type disclosed applicant's co-pending application Ser. No. 07/258,000, now U.S. Pat. No. 4,939,798 entitled "Leading Edge and Track Slider System for an Automatic Swimming Pool Cover."

A flexible vinyl fabric pool cover 11, is attached for winding around a cylindrical cover drum 12 with conically tapering end sections or hubs 13 supported for rotation at the end of a swimming pool (not shown). The front edge 14 of the cover 11 is supported by a rigid leading edge 15 spanning the width of the pool above the water between a parallel pair of conventional "C" channel swimming pool tracks 19 secured along the sides of the swimming pool. Cables 21, typically a Dacron line, are incorporated into and form a beaded tape 22 sewn to the side edges of the cover 11. The cables 21 extend from the front corners of the cover 11, are trained around pulleys 23 at the distal ends of the tracks 19, and return via return internal "C" channels within the track 19 to ultimately connect with and wind onto a pair of cable take-up reels 16. The beaded tapes 22 sewn to the side edges of the cover 11 are captured and slide within the conventional "C" channels within the respective tracks 19.

A reversible motorized drive 18 is coupled to the end of an axle shaft 17 extending coaxially from one of the conically tapering hubs 13 of the cover drum 12. A bearing block 24 receives and supports an axle shaft 20 coaxially extending from the conically tapering hub 13 at the opposite end of the cover drum 12 and allows both rotation and axial translation. The reversible drive 18 in turn is secured to a stationary base platform 26 in a manner which allows for axial translation, i.e., permits axial translation of the entire drive train for the cover drum 12 as indicated by the arrow 25.

Specifically, as is explained infra, it is desirable to be able to translate the cover drum 12, or, more particularly, its conically tapering hubs 13, perpendicularly relative to the beaded tape side edges 22 of the cover 11 captured and sliding with the "C" channels of the parallel tracks 19.

As shown in FIG. 2, the drive motor 18 is secured to a mounting bar 28 which in turn is fastened to the base platform 26. The base platform 2 is supported within and/or forms a structural component of a rigid hexahedral or "box" frame structure 30. The mounting bar 28 spans the distance between two parallel slots 27 cut through the platform 26 aligned with the rotational (longitudinal) axis of the cover drum 12. A pair of bolts 29 extending through the slots 27 screw into threaded holes through the mounting bar 28 fastening it to the platform 26.

It is preferable to suspend or hang the drive motor 18 from a base platform 26 comprising the top of the rigid hexadedral frame structure 30 because the cover drum and drive systems are typically located in trenches or bays which extending below the deck level of the pool which tend collect water. Water and electrically energized motors typically are not compatible. A conventional bearing 51 mounted on the front wall of the frame 30 receives and supports the drive shaft 52 from the motor 18 extending from the rigid frame structure 30 for connection to the drum axle 17. Essentially, the bearing 51 and mounting bolts 29 securing the mounting bar 28 define a rigid three point mounting cage within the hexahedral frame 30 which not only secures the motor 18 but also determines the axial orientation of the cover drum drive train indicated at 32 which includes the cover drum 12, hubs 13, axles, 17 and 20 cable reels 16, motor 18 and drive shaft 52.

Preferably, cover drum drive train 32 is supported at the end opposite the motor 18 by a single bearing block 24 and by the bearing 51 through the front wall of hexahedral frame structure 30. Accordingly, the motor and shaft bearings should have the capacity to support the anticipated load of the cover drum and cover roll 31. Additional bearing blocks similar to bearing block 24 can be journaled around to the respective supporting axles 17 and 20 to provide additional capacity (and/or rigidity) for mechanical supporting the drive train 32. However, care should be exercised in locating such additional bearing blocks to insure the desired range of axial translation of the cover drum drive train 32 and/or the conically tapering hubs 13.

As shown in FIG. 2, the means provided for adjusting the position of the cover drum drive train 32 perpendicularly relative to the tracks 19 includes a helically threaded shaft 53 threaded through the rear wall of the rigid hexahedral frame 30. The end 54 of the shaft 53 is mechanically coupled by a conventional non-rotating collar 56 to the motor frame 57. An adjustment knob or crank 58 is is mechanically fastened to the opposite end of the shaft 53 extending out of the hexahedral frame 30.

To adjust the position of the cover drum drive train 32, the cover 11 is extended/retracted to the half extended position across the pool. (This is a position where the tension on the cover 11, and it's associated beaded side edges 22 and cables 21 is at a minimum.) The bolts 29 securing the mounting bar 28 of the motor 18 are loosened sufficiently to allow translation of the cover drum drive train 32. The shaft 53 is rotated with crank 58 by hand to translate the cover drum drive train 32 to a new position. The bolts 29 are then tightened and the cover extended to it fully extended position covering the pool. The cover 11 should be then be completely retracted and then fully extended again while closely monitoring (observing) the effects of the adjustment.

It is possible, but not recommended, to adjust the position of the cover drum drive train 32 as the cover extends/retracts moving from the half-way position midway across the pool.

Figure 3:
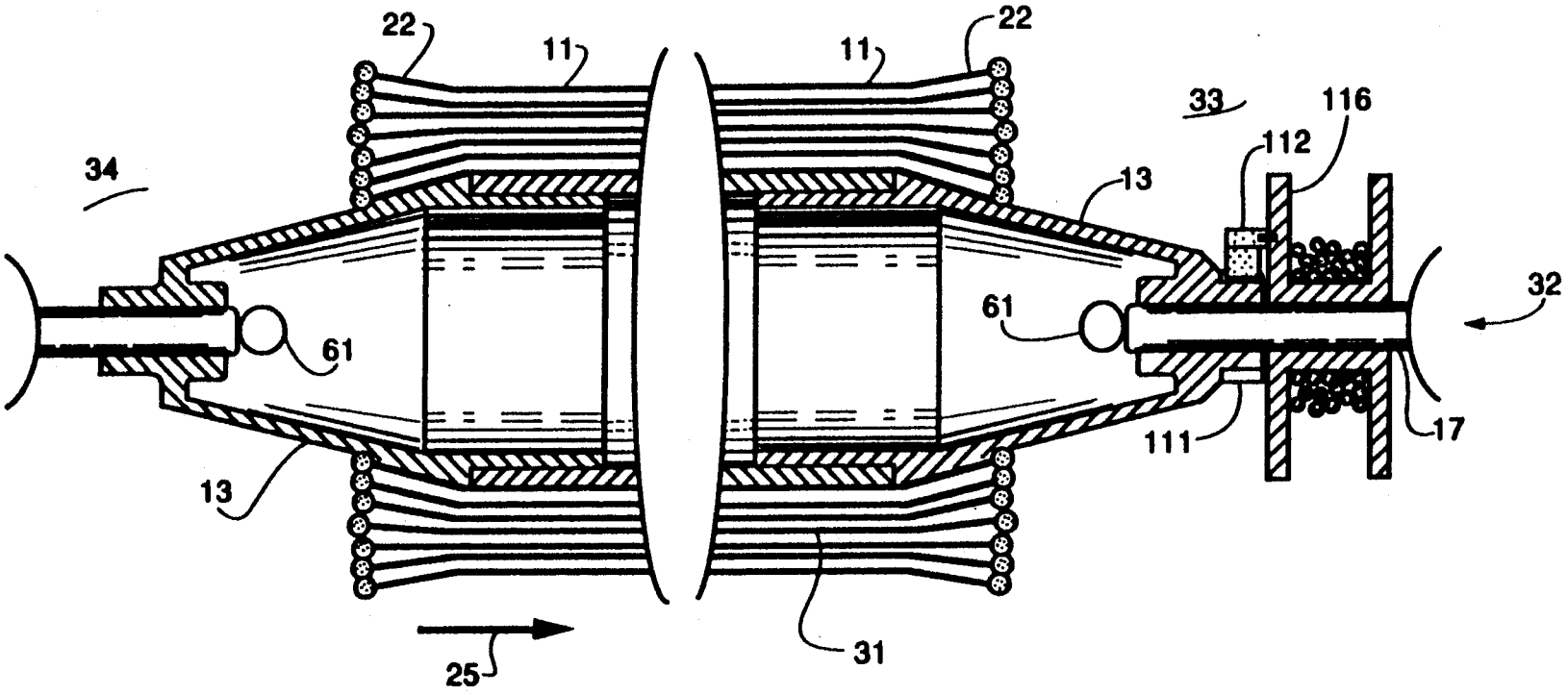
FIG. 3 is a cross section diagram of a cover drum with fixed, conically tapering end sections which illustrate the differences in diameters at the respective hubs and the central section of the cover roll and which also illustrates the components of conventional releasable ratcheting mechanism coupling between a cable take-up reel and the conically tapering hub.

In more detail, referring to FIG. 3, with fixed, conically tapering hubs 13, translation of the cover drum drive train 31 along its rotational axis simultaneously increases the diameter (winding rate) of the beaded tape 22 and adjoining cover 11 layers winding around the cover drum 12 at one end 33, and decreases the diameter (winding rate) of the beaded tape 22 and adjoining cover 11 layers winding around the cover drum 12 at the opposite end 34. That is to say, a single adjustment in the transverse position of the drive train 32 between the tracks 19 (FIGS. 1 and 2) accomplishes an inversely related, coupled effect at the cover edges 22 as the cover 11 winds and unwinds from around the cover drum 12.

More precisely, being able to translate the cover drum drive train 32 axially, enables one to precisely control or adjust the ratio of the respective lengths (equivalently the circumferences or diameters) of the roll layers of the beaded tape edges 22 of the cover 11 wound around each conically tapering hub 13 of the cover drum 12 per drum rotation. The effect accomplished is equivalent to that which would result if the rotating axis of the cover drum drive train 32 is canted at an angle slightly greater or less than 90° with respect to the tracks 19. In fact, by adjusting the axial position of the cover drum drive train 32 between the parallel tracks 19, it is possible to correct or compensate for misalignment of the cover drum drive train axis and the tracks 19.

Figure 4:
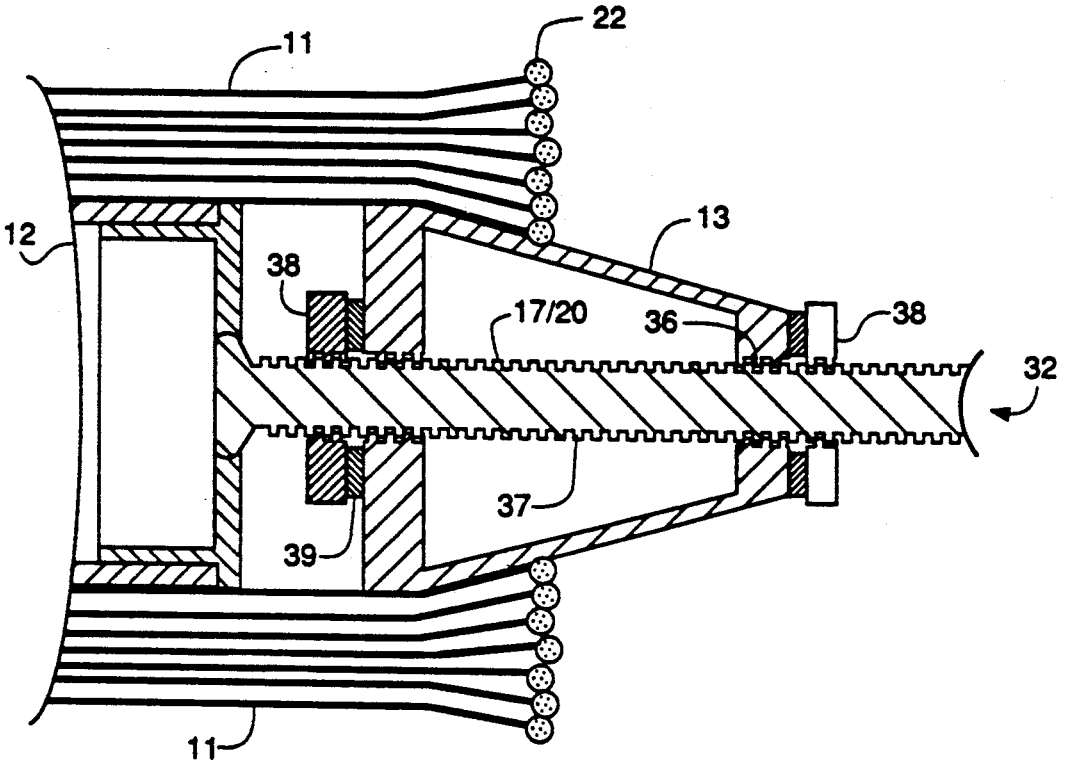
FIG. 4 is a cross section diagram of a cover drum with a movable, conically tapering hub.

Referring now to FIG. 4, in circumstances where axial translation of the cover drum drive train 32 is not feasible, or where it is desirable to also be able to independently adjust the end diameters of the cover roll, the conically tapering hubs 13 can be adapted for independent translation on the axles 17 and 20 perpendicularly with respect to the "C" channels of the pair of tracks 19 capturing the beaded tape edge 22 of the cover 11. In particular, the hubs 13 have a conventional helically threaded cylindrical passage 36 engaging a corresponding helical thread surface 37 around the axle 17/20. For adjustment, the hubs 13 are rotated relative to the axles 17/20 for axially translating the hubs 13. After adjustment, a pair of locking collars 38 also threadable engaging the axle 17/20 and washers 39 are snugged against either end of the hub 13 to lock it in place and prevent relative rotation between the axle 17/20 and hub 13.

Any conventional mechanical system for assuring co-rotation of the hub 13, axle 17/20 and cover drum 12, yet permit adjustment of axial position of the hub 13 on the axle 17/20 would be equally suitable to that described above and illustrated in FIG. 4. For example the hub 13 could be keyed to a longitudinal slot along the length of the axle 17/20 and locked in position by a conventional set screw.

The separate adjustment of the position of the conically tapering hubs 13 on the respective axles 17 and 20, allows for independent adjustment of the circumference of the respective roll layers of the beaded tape side edges 22 of the cover 11 at its respective ends 33 and 34. However, before the adjusting the respective positions of hubs 13, individually, one must unwind the cover 11 from the cover drum 12 and relieve any tension in it's associated beaded side edges 22 and associated cables 21. Once the conically tapering hubs 13 are fixed in position, however, it is possible to translate the entire cover drum drive train 32 to effect the above described coupled, but inversely related adjustment without unwinding the cover 11 from the cover drum 12 and without relieving the tension in the cables 21.

Referring now to FIG. 2, the diameter of the central region of the cover roll 31 around the cylindrical cover drum 12 as it winds and unwinds is manipulated or adjusted by thickening sections of the cover with angularly oriented strips 64 of a suitable material (foam) to effectively increase the thickness of the cover 11 in its central region. The increase in cover thickness due to the strips 64 increases diameter of the cover roll and the rate at which a central region of the cover (encompassing the strips 64 and extending to the leading edge 15) winds and unwinds from around the cover drum 12 per drum rotation as a function of position of the leading edge 15 of the cover relative to the cover drum 12.

It is preferred to orient the thickening strips 64 angularly with respect to the direction of travel of the cover such that the strips helically wind and unwind from around the drum to mitigate strain caused by differential stretching in the cover fabric in the affected transverse region of the cover over time.

For example, locating the strips 64 proximate the leading edge 15 as shown in FIG. 2, increases the length per drum rotation (rate) at which the central section of the cover 11 winds/unwinds when the cover approaches and extends from the the fully retracted position. In particular, when the cover 11 is fully or nearly retracted, the end diameters of the cover roll 31 (the beaded tape edges 22 and adjoining cover 11 layers winding around the respective conical hubs 13) are at a maximum. When the end diameters of the cover roll 31 are greater than that of the central region at that point, then a greater length of the cover 11 at its edges 22 will wind/unwind than in its central region per drum rotation. Accordingly, in instances where water (from rain or other sources) has collected on the surface of the cover 11, the weight of the water will billow the central region of the cover down to the surface of the pool as the cover approaches the nearly retracted position.

It is preferred, but not necessary, that the thickened sections of the cover or strips 64 comprise sealed pockets containing a compressible buoyant material such as foam. Such pockets are formed by welding, bonding and/or sewing the edges of pieces of cover material to the under surface of the pool cover 11 with the foam or other material sandwiched in between.

It also maybe be necessary in order to achieve certain design and operational goals to vary the thickness of the strips 64 as a function of of longitudinal position measured relative to the distance between the extending/retracting leading edge 15 and the cover drum around which the cover 11 and strips 64 wind. For example, the diagonally oriented strip pockets 64 may contain a single layer of foam at an end section extending toward the cover drum 12, increase to two layers in their middle sections, and again increase to three or more layers at the ends proximate the leading edge 15.

By bonding a pair strips 64 centrally on the under surface of the cover 11, proximate the leading edge 15, as shown in FIG. 2 the rate of winding/unwinding of the cover roll in the central region can be increased to match, and if necessary, to exceed the rate of cover winding/unwinding at the cover ends. A desired effect of the strips 64 is, of-course, removal of the billow in the central region of the cover 11 during retraction as the leading edge 15 approaches the fully retracted position adjacent the cover roll causing the water collecting on the surface of the cover to spill through the mesh screen 63 into the pool. And during extension, a desired effect of the strips 64 is to allow the central region of the cover to immediately billow down to the water surface of the pool.

As illustrated in FIGS. 1–4, the conical hubs 13 taper from a base diameter equal to that of the cover drum 12 with the base of each hub 13 located adjacent the cover drum. It should be appreciated that the hubs 13 can be reversed with the apex of the hubs 13 adjacent the cover drum 12 without significantly changing the described inversely related, coupled effect on winding and unwinding of the cover edges upon translation of the drive 32. However, the drive train would be translated in an opposite direction to achieve the same effect as that achieved when the base of the conical hubs 13 are adjacent to the drum.

Also, it should be appreciated that the slope or angle of the conical surface can be varied depending upon desired operating attributes of a particular system and cover. When the bases of the conical hubs 13 are adjacent the cover drum 12 they should not have a diameter exceeding that of the cover drum 12, i.e. the cover drum diameter is the effective base diameter of the hubs 13. Where the apex of the surface is located adjacent the cover drum 12, base diameters of the hubs 13 can exceed that of the cover drum 12.

The conically tapering cover drum hubs 13 and adjustments afforded by axial translation of the cover drum drive train also has other significant effects on the operation of the invented automatic pool cover system.

For example, in the system illustrated in FIGS. 1 and 2, the functional relationships of the cable take-up reels 16, the floating helical tensioning spring 41, and the ratio of the respective diameters of the roll layers of the beaded tape edges 22 of the cover 11 around the conical hubs 13 of the cover drum 12 determine the different and varying rates at which the cover 11, its side edges and cables 21 wind and unwind from around the drum 12 and the take-up reels 16 respectively.

In explanation, the cable take-up reels 16 are keyed to the axle 17 extending between the cover drum 12 and reversible drive 18. As illustrated, (FIGS. 1 and 2) the cover drum 12 and take-up reels 16 corotate, i.e., rotate at the same rate. The floating helical spring 41 with a pulley 42 secured at each end functions as a floating tensioning take-up mechanism to compensate for the different and varying rates at which the cover 11, its side edges and cables 21 wind and unwind from around the drum 12 and the take-up reels 16 respectively. The cables 21 wind around the take-up reels 16 in a direction opposite to that which the cover 11 winds around the cover drum 12, i.e. the cables 21 unwind from the take-up reels 16 as the cover winds around the cover drum 11, and visa versa. Pulleys 43 are incorporated into the respective cable paths to implement the necessary changes in direction of the cables 21 between the tracks 19 and the take-up reels 16 for coupling the pulleys 42 at the ends of the floating spring 41 into the cable system. The floating spring 41 is typically placed within a PVC tube 44 as a safety precaution to prevent debris and fingers from being captured between its expanding and contracting helical coils during retraction and extension of the cover 11.

Referring to FIG. 3, a conventional releasable ratcheting mechanism couples one take-up reel 16 and the hub 13. A similar releasable ratcheting mechanism couples between the other take-up reel 16 and the axle 17. Such ratcheting mechanisms typically include a stepped surface 111 integral with a circumferential surface of the hub 13 or axle 17 or a coaxial circumferential surface carried by the take-up reel 16. A dog 112, pivotally secured at one end to either the reel 16 or the axle 17, engages the stepped surface 111 when the stepped surface rotates in one direction and slides over the stepped surface 111 when it rotates in the opposite direction. A compression or tension spring (not shown) is typically utilized to force the dog against the stepped surface. To release such ratcheting mechanisms the dog is lifted out of engagement with the stepped surface allowing the shaft 17 and reels 16 each to free wheel independent of the other.

The ratcheting mechanisms allow the take-up reels 16 to be independently rotated on the axle 17 to take up slack for adjusting or pre-tension the cables 21, i.e., expand the spring 41. When required for maintenance, the ratcheting mechanisms are released allowing the take-up reels 16 to free wheel on the axle 17 relieving the tension and allowing slack in the cables 21.

The floating spring 41 inherently establishes and equalizes the tension loads on the respective cable paths. Accordingly, any increase in the friction load in one cable path inherently increases the tension load on both cable paths equally. The floating spring 41 also inherently compensates for differences in lengths of the respective cable paths as the cover 11 and it's side edges 22 wind and and unwind from around the cover drum 12 and conical hubs 13.

In particular, the floating spring 41 translates between the respective pulleys 43 lengthening one cable path and shortening the other inherently counter balancing or compensating for the difference in cable lengths and beaded side edges 22 of the cover 11 being wound and unwound from around the respective take-up reels 16 and conical cover drum hubs 13 per single cover drum rotation.

Two coupled closed loop cable paths are thus provided each of which incorporates, in sequence:

(a) the conically tapering hub 13 co-rotating with the cover drum;

(b) the beaded tape edge 22 sewn to the pool cover 11;

(c) a slider element carrying the rigid leading edge 15;

(d) the end pulley 23 located at a distal end of the track 19;

(e) the corner pulley 43 located proximate the cover drum 12 aligned with the internal track return "C" channels for directing the cable 21 from such return channel to the pulley 42 at the end of the floating spring 41;

(f) the reel pulley 43 receiving the cable 21 from the pulley 42 at the end of the floating spring 41 and directing it onto the take-up reel 16; and (g) the terminating take-up reel 16.

From the above, it should be understood that the respective lengths of the beaded side edges 22 of the cover 11 winding and unwinding from around the respective conical hubs 13 of the cover drum 12 per drum rotation will essentially determine the orientation of the rigid leading edge 15 moving and supported between the tracks 19. Accordingly, axial translation of the cover drive train 32 and/or independent axial translation of the conical cover drum hubs 13, provides a mechanism for orienting the rigid leading edge 15 between the tracks 19.

The ratcheting mechanisms incorporated into the journal couplings of the respective take-up reels 16 and the axle 17 can also be utilized to lengthen and shorten the respective cable paths as well as to center or adjust the position of the floating spring 41, e.g. shortening one of the cable paths with one of the ratcheting mechanisms translates the floating spring 41 between the pulleys 43 lengthening the other cable path when the other ratcheting mechanism is released.

To extend the cover 11 across the pool, the driving mechanism 18 rotates the axle 17 in a first direction engaging the ratcheting mechanisms to simultaneously wind the cables 21 around the take-up reels 16 and unwind the cover 11 from the cover drum 12. The sources of resistance retarding extension of the cover across the pool are:

a. The friction of the sliders carrying the leading edge 15;

b. The friction of beaded tapes edges 22 sliding within the "C" channels of the respective tracks 19;

c. The friction of the cover sliding across the surface of the deck at the edges of the pool (top track units only); and d. The friction of the cover sliding across the surface of the water in the pool;

The inertial resistance of the cover drum 12 and cover 11 wound around the drum 12 is carried directly by the driving means.

Because of the differential in the travel of the cover edges 22 unwinding from the cover drum hubs 13 and the cables 21 winding around the take-up reels 16, initially the spring 41 is expanded and the tension load on the cable paths is at a maximum. The tension load on the cable paths decreases as the leading edge 15 approaches the mid-point across the pool, and then again begins to increase as the leading edge 15 passes the midpoint and approaches the fully extended position abutting against the far end of the pool.

When the cover 11 is retracted, the driving mechanism 18 rotates in the opposite direction to simultaneously unwind the cables 21 from the take-up reels 16 and wind the cover 11 around the cover drum 12. The ratcheting mechanisms prevent the take-up reels 16 from rotating at a faster rate than the axle, but will allow the axle to rotate at a faster rate than the take-up reels 16. It should be appreciated that the tension load imposed by the expanded floating spring 24 on the cable paths maintains the engagement of the ratcheting mechanism. And, again because of the differential in travel of the cover 11 winding around the cover drum 12 and it's hubs 13, and the cables unwinding from the take-up reels 16, the tension load on the cable paths decreases from a maximum at the fully extended position to a minimum at the half retracted position and then again increases to a maximum at the fully retracted position.

The actual position of minimum tension load may vary depending on the respective diameters of the ends of the cover roll 31 (layers of the beaded edges 22 and cover 11 wound around the conical hubs 13), the diameter of the central region of the cover and the diameter of the cable layers wound around the take-up reels 16. In fact, it is possible to utilize this property to adjust the point of minimum tension load on the cable paths by varying the initial (unwound) diameters of the take-up reels 16 coil layers of excess cable 21 and/or the initial (unwound) diameter of the cover drum 12 with layers of unused cover. The cover should always be extended or retracted to the point of minimum tension loading on the cable paths before adjusting the pre-tension load of the cable paths.

As shown in FIGS. 1 & 2, the cover 11 has a fine mesh screen 63 welded into it centrally near its front edge. Floats are incorporated into the welds to hold the screens 63 above the surface of the water when the cover 11 is drawn across the surface of the water. Care should be taken to locate the mesh screens 63 such that weight of the water collecting on the surface of the cover 11 billowing it down to the water surface of the pool does not excessively bow the leading edge 15 downward during retraction. The mesh screens 63 allow water collecting on the top of the cover 11 to drain into the pool as the cover is retracted uncovering the pool while retaining any solid debris on the surface of the cover. [See U.S. Pat. No. 3,982,286, Foster.]

Also, with reference to FIGS. 1–3, the conically tapering hubs 13 include diametrically aligned holes 61 near the apex of the hub adapted to receive a longitudinal bar or crank (not shown). By inserting the bar through the holes 61 it is possible to rotate the cover drum drive train 32 manually, the length of the bar providing the mechanical advantage necessary to rotate the drive train overcoming both the inertial and frictional resistances in the system. In effect, the holes 61 though the hubs 13 function as engagement means for a crank enabling the drive train of the system to be rotated manually as well as by the reversible motor 18. Accordingly, the cover 11 can be extended and retracted during power outages. The ability to manually turn or crank the drive train 32 of the system is also advantageous in installation, maintenance and care of the system in that the drive train 32 of the system can be rotated incrementally without having to engage the motor drive 18.

The invented conically tapering hubs also significantly improve control and adjustment of cover extension and retraction in clutch and brake automatic pool cover systems of the type pioneered by Lamb, (See U.S. Pat. No. 4,060,860, Lamb). Clutch and brake type automatic pool cover systems require a mechanism to compensate for differences in the rates at which the cables 21 wind around the respective cable take-up reels 16 during cover extension. In particular, the diameter of the cables winding around the respective take-up reels 16 frequently differ, depending on the distribution of the cable coil layers around the reel. More cable 21 is wound around the reel 16 of the larger diameter than the smaller in a single rotation, a fact which would cause the boom 14 to skew jamming the cylindrical sliding edges 35 of the attached sliders 34 in one or the other of the "C" channels of the track 21.

To correct this problem, a floating pair of coupled pulleys 101 are incorporated into the respective cable paths 102 (shown in phantom in FIG. 1) between the take-up reels 16 and tracks 21. In operation, the couple pulleys 101 will translate toward the larger diameter take-up reel 16 lengthening the cable path for the cable 21 being wound around the other smaller diameter take-up reel 16 thereby counter balancing or compensating for the difference in cable lengths being wound around the respective take-up reels in any single rotation. The friction resistance of cover being drawn across the pool is both of sufficient symmetry and magnitude to provide the necessary tensile force for floating the coupled pair of pulleys and for maintaining square alignment of the boom 15 between the tracks 19 as it moves across the pool.

It should also be appreciated, that like the floating spring 41 and pulleys 42 at its ends in the previously described system, the coupled pair of pulleys 101 equalize the tension loads on the respective cable paths which also tends to maintain square alignment of the rigid boom during extension.

During cover retraction, braking mechanisms (not shown) restrain the free wheeling take-up reels as the cables unwind, to provide sufficient tension in the respective cable paths to float the coupled pulleys 101. As during cover extension, the coupled pulleys 101 again equalize the tension loads in the cable paths during retraction.

Since the rotation of the take-up reels and cover drum are decoupled except for the cables, it is possible, simply by adjusting the longitudinal position of the invented conically tapering hubs to control the orientation of the leading edge between the tracks capturing the beaded side edges of the cover during cover extension, a feat that previously could only be partially accomplished by adjusting the lengths of the cables unwound from the respective take-up reels when the cover is completely retracted because of the unpredictability in the respective diameters of the take-up reels as the respective cables are wound up. With the invented conical hubs it is the cover rather than the cable lengths that determine the orientation of the leading edge.

Of greater significance are the effects of the possible adjustments provided by invented conical hubs on cover retraction in clutch and brake systems. Specifically, only the cover determines the orientation of the leading edge during retraction. Accordingly, unpredictable variables as cover wear, cover shrinkage, cover stretching, cover folds, and in particular, changes in the frictional braking force at the respective take-up reels over time, can introduce biases into the cover as it winds around the cover drum. In slider systems, such introduced biases can pull the leading edge of the cover out of square causing it to bind in the track. Such introduced biases or "skewness" also prevents the cover from being either fully retracted or extended, i.e., one side of the cover will reach the fully retracted or extended position before the other side leaving a triangular section of the pool covered or uncovered respectively.

Previously, in order to correct for skewness in the prior art brake and clutch decoupled systems, i.e., those without a floating pair of coupled pulleys 101, it was necessary to stop cover retraction, and manually pull on only one side cover unwinding the entire cover from around the cover drum to a point where the leading edge is squarely oriented. Slack in the respective cables is then eliminated by rotating the take-up reels, and then an attempt is made to again retract the cover. If the "skewness" reoccurs after the describe procedure, with such prior art systems, the cover would again have to be manually unwound from the cover drum and the brakes on the respective take-up reels adjusted increasing resistance on the faster winding side of the cover and decreasing resistance on the slower winding side. As should be appreciated, such corrective procedures involve hard manual labor, are inexact, tedious, and time consuming. Typically, such procedures should not be attempted by any person other than skilled service personnel familiar with the idiosyncrasies of the particular system.

In contrast, with the invented conically tapering hubs, it is only necessary to stop retraction at the point where the skewness begins to initiate in such prior art clutch/brake decoupled systems, loosen the bolts 29 securing the motor 18 in the box frame 30, and then translating the drive train longitudinally by turning the adjustment knob/crank 58 such that the slower winding beaded tape edge 22 winds around a larger diameter section section of the particular hub 13, and the faster winding beaded tape edge 22 around a smaller diameter section of the hub 13 at the opposite end of the cover drum 12. The mounting bolts 29 are then tightened and the cover extended and again retracted. This process can repeated until the "skewness" is eliminated. And, where such systems are equipped with a floating pair of coupled pulleys 101, it is not even necessary to fiddle with the friction brakes acting on the take-up reels, because the floating coupled pulleys 101 inherently equalize the tension loads in the respective cable paths. In clutch and brake decoupled systems which do not include floating coupled pulleys 101, the brakes acting on the take-up reels need only provide sufficient frictional resistance to assure that the respective beaded tape edges 22 of the cover 11 wind tightly around the respective conical hubs 13.

To preclude twisting of the cable paths between the pulleys 103 and the coupled pulleys 101, because of slack during cover retraction it maybe necessary to secure the coupled pulleys to a conventional sliding track (not shown). Such a sliding track could also serve to limit the translation of the coupled pulleys 101 between the pulleys 102 incorporating the coupled pulleys into the respective cable paths.

To further improve performance in such clutch and brake type pool cover systems, the pair of pulleys 101 maybe coupled together with a tension spring in the manner previously described in context of the automatic pool cover systems utilizing floating spring tensioning take-up mechanisms. To explain, in clutch type pool cover systems, the maximum tension load on the respective cable paths occurs upon initiation of the extension cycle. The drive mechanism, via the cables, must overcome the inertial resistance of the cover drum with a fully wound up cover in addition to the frictional resistance of the sliders and beaded tape edges in the "C" channels of the track. (The cover drum free wheels when the take-up reels are rotatably driven to wind up the cables.) Typically, such clutch mechanisms tend to free wheel between the respective engagement positions with the cover drum and take-up reels. Accordingly, upon initiating cover extension, the respective cable paths experience shock loading. Such shock loading frequently leads to mechanical and fatigue failures, and, in fact, necessitates the use of shear pins in the drive train to prevent catastrophic failure. Incorporating a tensioning spring to couple the pair of pulleys 101 provides the necessary resiliency in the cable paths to prevent such shock loading, and at the same time, provides a mechanism for increasing tension load on the cable paths to overcome the initial inertial resistance of the fully loaded cover drum.

The invented improvement of conically tapering hubs at the end of the cover drum for automatic swimming pool covers has been described in context of both representative and preferred embodiments. There are many modifications and variations which can be made to the invented improvement and which, while not exactly described herein, fall within the spirit and the scope of invention as described and set forth in the in the appended claims.

I claim:

1. A system for extending and retracting a flexible rectangular cover having beaded side edges back and forth across a liquid contained in a pool where the cover is supported by and slides on the surface of the liquid, and is anchored by its respective beaded side edges, each of which are captured and slide within a "C" channel of a pool cover track secured along opposite side edges of the pool, comprising, in combination:

a rigid structural boom spanning across the pool secured to the front edge/end of the cover for carrying and supporting the front edge of the cover above the liquid surface as the cover is drawn back and forth across the pool;

means for supporting the rigid boom as it translates back and forth across the pool;

a cylindrical cover drum having a length less than the width of the cover supported for rotation about its longitudinal axis at one end of the pool by axles extending from its respective ends, the cover winding and unwinding from around the periphery of the drum as it retracts and extends across the pool;

a conically tapering hub located at each end of the cover drum coaxially rotating with the cover drum around which the respective beaded side edges of the cover wind and unwind as the cover retracts and extends across the pool;

a cable extending from the respective beaded side edges at the cover's front corners, the cables extending from the front corners of the cover to wind and unwind from around at least one rotatable cable take-up reel;

drive means mechanically coupled to one axle supporting the cover drum and to the cable take-up reel for rotating the cover drum and the cable take-up reel to extend and retract the cover across the pool;

means for translating the cover drum and conically tapering hubs longitudinally along the longitudinal and rotational axis of the cover drum simultaneously increasing a diameter which one beaded side edge of the cover winds about one hub and decreasing a diameter which the other side edge of the cover winds about the other hub.

2. In a system for extending and retracting a flexible rectangular cover having beaded side edges back and forth across a liquid contained in a pool, where the cover is supported by and slides on the surface of the liquid, including:

parallel pool cover tracks secured along opposite side edges of the pool each having a "C" channel in which the respective beaded side edges of the cover are captured and slide;

a rigid structural boom spanning across the pool secured to the front edge/end of the cover for carrying and supporting the front edge of the cover above the liquid surface as the cover is drawn back and forth across the pool;

means for supporting the rigid boom as it translates back and forth across the pool;

a cylindrical cover drum having a length less than the width of the cover supported for rotation about its longitudinal axis at one end of the pool by axles extending from its respective ends, the cover winding and unwinding from around the periphery of the drum as it retracts and extends across the pool;

a cable extending from the respective beaded side edges at the cover's front corners to connect with wind and unwind from around at least one rotatable cable take-up reel;

drive means mechanically coupled to one axle supporting the cover drum and mechanically coupled to the cable take-up reel for rotating the cover drum and the cable take-up reel to extend and retract the cover across the pool;

the improvement, comprising in combination therewith:

a conically tapering hub located at each end of the cover drum coaxially rotating with the cover drum around which the respective beaded side edges of the cover wind and unwind as the cover retracts and extends across the pool; and means for translating the cover drum and conically tapering hubs longitudinally along the longitudinal and rotational axis of the cover drum simultaneously increasing a diameter around which one beaded side edge of the cover winds about one hub and decreasing a diameter around which the other side edge of the cover winds about the other hub.

3. The system of claims 1 or 2 wherein the axles supporting the cover drum for rotation extend from the conically tapering hubs, the hubs having a base outside diameter equal to that of the cover drum, the base of the hubs being the ends of the cover drum.

4. The system of claim 3 wherein at least one of the conically tapering hubs have at least one diametrically oriented passageway for receiving a bar, the passage way being located proximate the axle extending from the hub.

5. The system of claim 3 wherein the beaded side edge of the cover is a tape secured around a cable, the tape in turn being secured to each side of the cover, and wherein the cable connecting between the front corners of the cover and the take-up reel is an integral extension of that cable.

6. The system of claim 5 wherein the cable take-up reel is coaxial with one of the axles extending from one of the conically tapering hubs, and wherein each swimming pool track includes an end pulley located at the end of the pool opposite the cover drum and a return channel for accommodating the cable extending from the front corner of the cover and the take-up reel.

7. The system of claim 6 wherein the cable take-up reel is partitioned, the cable extending from one beaded side edge of the cover winding and unwinding from around one partition, the other cable extending from the other beaded side edge of the cover winding and unwinding from around the other partition.

8. The system of claim 7 wherein the means for supporting the rigid boom as it translates back and forth across the pool includes:

(a) a pair of rigid sliders each captured and sliding within the the same "C" channel of the pool cover track secured along the side edge of the pool as one of the beaded side edges of the cover;

(b) attachment means extending from the boom at it's ends for establishing a translating and pivoting coupling between the ends of the boom and the sliders; and (c) means for anchoring each slider to the cable extending from the respective beaded edges of the cover proximate the cover's front corners.

9. The system of claim 8 further including a means for maintaining alignment of the rigid boom squarely between the respective tracks.

10. The system of claim 9 wherein the means for maintaining alignment of the rigid boom squarely between the respective tracks include means coupling between the respective cables for increasing and decreasing lengths of the respective cables connecting between each slider and the take-up reel corresponding to the difference between the respective lengths of cable wound around the cable take-up reel per rotation and for inherently equalizing tension load on the respective cables.

11. The system of claim 10 wherein the means coupling between the respective cables comprises, in combination, a coupled pair of pulleys, each cable having a closed loop cable path which incorporates one of the of the coupled pair of pulleys, the coupled pair of pulleys floating between a return position in each cable path between the take-up reel and the respective slider.

12. The system of claim 11 wherein each closed loop cable path at least incorporates, in sequence:

(a) a conically tapering hub secured at the end of the cover drum;

(b) the beaded edge of the pool cover;

(c) the slider;

(d) the end pulley located at the distal end of a the track directing the cable into the return channel within the pool cover track adjacent the "C" channel;

(e) a corner pulley located proximate the cover drum aligned with the track return channel for directing the cable from the return channel to one of the pulleys of the coupled pair of pulleys;

(f) one of the pulleys of the coupled pair of pulleys;

(g) a reel pulley receiving the cable from the pulley of the coupled pair of pulleys directing the cable from the return pulley onto the take-up reel; and (h) the take-up reel, whereby, the coupled pair of pulleys are suspended and translate between the respective reel pulleys of the respective cables to lengthen and shorten the respective cable paths compensating for any differential in the respective rates at which the respective cables wind around the cable take-up reel when it is rotated, and whereby, the tension load on one closed loop cable path is inherently transferred to the other cable path, thereby equalizing the tension load on the respective closed loop cable paths.

13. The system of claim 12 further including a second return pulley incorporated into at least one of the closed loop cable paths receiving the cable from the pulley of the floating pair of coupled pulleys directing it to the reel pulley whereby the coupled pair of pulleys float between the second return pulley and one of the reel pulleys.

14. The system of claim 13 wherein the take-up reel and the cover drum rotate about the same axis, and wherein the driving means rotating the cover drum and the take-up reel is reversible; and further including:

(i) a clutching mechanism for decoupling the driving means from the cover drum and rotating the take-up reel in a first direction for winding up the cables to extend the cover across the pool, and for decoupling the take-up reel from the driving means and rotating the cover drum in a direction opposite the first direction to wind the cover around the cover drum retracting the cover from across the pool.

15. The system of claim 14 wherein the coupled pair of pulleys are coupled by a helical tensioning spring.

16. The system of claim 13 wherein:

(i) the driving means rotating the cover drum and the take-up reel is reversible, (j) the take-up reel is keyed to and turns with an axle extending from a conical hub, (k) the cables and cover are fastened to the take-up reel and cover drum respectively to oppositely wind and unwind whereby the cables unwind from the take-up reel as the pool cover winds around the cover drum when the driving means rotates the axle in a first direction, and the cables wind around the take-up reel and the pool cover unwinding from the cover drum when the driving means rotates the axle in the a direction opposite to the first direction;

and further including:

(m) a helical tension spring coupling between the coupled pair pulleys for taking up and yielding slack in the respective cables as necessary to allow for differential travel between the cables and the cover and between the cables as they wind and unwind respectively.

17. The system of claim 16 further including a releasable ratcheting means coupling between the take-up reel and the conical hub adjacent thereto for allowing the take-up reel to rotate on the axle in a direction for winding up the cables expanding the helical tension spring to pre-tension the cable paths.

18. The system of claim 3 wherein the means for translating the cover drum and conically tapering hubs longitudinally along the longitudinal and rotational axis of the cover drum comprises, in combination, (a) a hexahedron frame having an axle port through a front vertical wall;

(b) a bearing means mounted in the axle port receiving one of the axles extending from the conically tapering hub secured at one end of the cover drum for rotatably supporting the cover drum, conically tapering hubs and axles;

(c) a bearing block means receiving the remaining axle extending from the conically tapering hub secured at the other end of the cover drum for rotatably supporting the cover drum, conically tapering hubs and axles;

(d) means coupled between the end of the axle extending through the front wall of the hexahedron frame and the hexahedron frame for translating the axle longitudinally relative to the the front wall of the frame.

19. The system of claim 18 wherein the means coupled between the end of the axle extending through the front wall of the hexahedron frame and the hexahedron frame comprises, in combination, (e) the drive means coupled to and extending from the end of the axle, (f) a top wall of the hexahedron frame having a least one mounting slot aligned parallel to the longitudinal and rotational axis of the cover drum;

(g) securing means extending through the mounting slot for releasably securing the drive means to the top wall of the hexahedron frame;

(h) a rotatable, helically threaded shaft extending from the drive means into and through a reciprocal helically threaded port through a back wall of the hexahedron frame opposite its front wall, the shaft having a polygonal head at its distal end exterior the hexahedron frame adapted for engagement by a wrench, whereby, upon loosening the securing means, and turning the helically threaded shaft, the drive means, the axles, the hubs, and the cover drum (drive train) can be translated longitudinally along the longitudinal and rotational axis of the cover drum.

20. The system of claim 1 or 2 wherein the conically tapering hubs are independently translatable along the axles supporting the cover drum for rotation, and further including releasable means for locking the respective hubs in position on the axle.

21. The system of claim 20 wherein the axles extending from the respective ends of the cover drum include a helical thread and means for keying the axles to the respective conically tapering hubs.

22. The system of claim 21 wherein the releasable means comprises a least one locking collar turning on the helical thread of the axle which can be tightened against the hub for holding the hub at a particular longitudinal position on the axle.

23. The system of claim 20 wherein the axles extending from the respective ends of the cover drum include a helical thread and wherein each conically tapering hub includes a coaxial, helically threaded passageway mating with the helical thread of the respective axles, whereby, upon releasing the releasable means, the hubs can be translated on the respective hubs by turning the hubs relative to the axle.

24. The system of claim 23 wherein the releasable means comprises a least one locking collar turning on the helical thread of the axle which can be tightened against the hub for holding the hub at a particular longitudinal position on the axle.

25. The system of claim 23 wherein the releasable means comprises a first locking collar turning on the helical thread of the axle between the drum and the hub and a second locking collar turning on the helical thread of the axle between the hub and a means supporting the axle for rotation, whereby the first and second locking collars can be tightened against the hub for holding the hub at a particular longitudinal position on the axle and keying it to the rotation of the axle.

26. The system of claim 1 or 2 wherein the cover has at least one thicker cover section for increasing a rate at which a transverse region of the cover encompassing that thicker section and longitudinally extending therefrom to the boom winds and unwinds from around the cover drum, the increase in rate occurring during cover extension and retraction when the particular thicker cover section of the cover winds and unwinds from around the cover drum.

27. The system of claim 26 wherein the cover includes at least one mesh covered opening located proximate the rigid boom in a central region of the cover and wherein the thicker cover section of the cover is located in a transverse section of the cover diagonally extends from a point proximate the mesh covered opening toward the cover drum, whereby such thicker cover section helically winds and unwinds from around the cover drum.

28. The system of claim 27 wherein the cover has top and bottom surfaces, the bottom surface sliding on the surface of the liquid in the pool, and wherein the mesh cover opening has a configuration of a slot oriented parallel to the boom, and wherein there are at least two thicker cover sections each located in a strip extending diagonally from a point proximate an end of the mesh covered slot opening toward the beaded side edges of the cover and the cover drum, whereby, billowing in a central region of the cover due to liquid collecting on and draining from the top surface of the cover into the pool via the mesh cover slot opening during cover retraction is increasingly reduced as the strips of the thicker cover sections wind around the cover drum.

29. The system of claim 26 wherein the thicker cover section comprises a thickening material secured to a surface of the cover.

30. The system of claim 29 wherein the cover has a top and bottom surface and the thickening material is secured to the bottom surface of the cover.

31. The system of claim 26 wherein the thicker cover section comprises, in combination, one surface of the cover, a piece of material secured at its edges to the surface of the cover forming a pocket, and a buoyant material contained in the pocket.

32. The system of claim 31 wherein the cover has a top and bottom surface, and further including at least one slot opening located proximate and oriented parallel to the boom and wherein pockets containing the buoyant material are located on the bottom surface of the cover, one pocket surrounding the slot opening and at least one pocket diagonally extending from the pocket surrounding the slot opening toward the beaded side edges of the cover and the cover drum, the pockets of buoyant material supporting the slot opening above the liquid surface of the pool during extension and retraction of the cover, whereby, billowing in a central region of the cover due to liquid collecting on and draining from the top surface of the cover into the pool via the slot opening during cover retraction is increasingly reduced as the pocket extending from the slot opening helically winds around the cover drum.

33. The system of claim 32 wherein the slot opening is screened and is located in a central transverse section of the cover proximate the boom.

34. The system of claim 33 wherein the pocket extending longitudinally toward the cover drum, comprises two separate strip pockets diagonally and symmetrically extending oppsitely from points proximate the respective ends of the pocket surrounding the slot opening longitudinally toward the beaded side edges of the cover and the cover drum.

35. The system of claim 33 wherein the pocket surrounding the slot opening and the pocket extending therefrom longitudinally toward the cover drum is a single sealed pocket.

36. The system of claim 32 wherein the material forming the sealed pockets in combination with the bottom surface of the cover forming is composed of the same material as the cover, and is welded to the cover.

37. The system of claim 31 wherein the sealed pocket varies in thickness as a function of degree of extension/-retraction of the boom carrying the front edge of the cover across the pool.

* * * * *